United States Patent [19]

Christl

[11] 3,957,263

[45] May 18, 1976

[54] TELESCOPIC SUCTION MEMBER FOR FEEDING SHEET MATERIAL

[75] Inventor: Klaus Christl, Chavannes, Switzerland

[73] Assignee: J. Bobst & Fils S.A., Switzerland

[22] Filed: Mar. 2, 1973

[21] Appl. No.: 337,749

[30] Foreign Application Priority Data

Mar. 29, 1972 Switzerland ..... 4708/72

[52] U.S. Cl. ..... 271/102; 269/21; 271/132; 294/64 R

[51] Int. Cl.² ..... B65H 3/08

[58] Field of Search ..... 294/64 R, 65; 271/90–93, 102, 103, 132, 135, 143, 112, 99; 267/57.1 R, 150; 214/8.5 D; 269/21

[56] References Cited

UNITED STATES PATENTS

| | | | |
|---|---|---|---|
| 1,409,781 | 3/1922 | Rimailho | 267/57.1 R |
| 2,749,119 | 6/1956 | Battey | 271/91 |
| 2,811,352 | 10/1957 | Bornemann | 271/102 X |
| 2,869,439 | 1/1959 | Wilcox | 271/102 X |
| 3,476,380 | 11/1969 | Calistrat | 271/132 X |
| 3,482,829 | 12/1969 | Kidby | 267/35 |
| 3,510,126 | 5/1970 | Romanens | 271/102 |
| 3,711,142 | 1/1973 | Wolski | 294/64 R |
| 3,761,072 | 9/1973 | Deering et al. | 271/102 X |

FOREIGN PATENTS OR APPLICATIONS

| | | | |
|---|---|---|---|
| 536,388 | 1/1957 | Canada | 271/102 |

*Primary Examiner*—Evon C. Blunk
*Assistant Examiner*—Bruce H. Stoner, Jr.
*Attorney, Agent, or Firm*—Hill, Gross, Simpson, Van Santen, Steadman, Chiara & Simpson

[57] ABSTRACT

Apparatus for handling sheet material incorporates a suction member for engaging and lifting individual sheets in order to separate and feed them. The suction member is mounted on a telescopic structure adapted to move outwardly to engage a sheet and to retract the sheet, once engaged, into a feeding position. The head of the suction member is mounted on a swivel arrangement to permit it to adapt to the plane of the sheet.

22 Claims, 6 Drawing Figures

TELESCOPIC SUCTION MEMBER FOR FEEDING SHEET MATERIAL

BACKGROUND OF THE INVENTION

1. Field of the Invention

The present invention relates to sheet handling devices and more particularly to sheet handling devices employing pneumatic means for gripping and feeding the sheets.

2. The Prior Art

It is conventional to employ a suction means for gripping and feeding sheets in apparatus for processing sheets such as die cutting machines, printing presses and the like. In one arrangement, a movable suction plate is employed formed generally of a flat plate having apertures therein connected with a vacuum source, adapted for engaging and drawing a sheet down into register with the plate. Such a mechanism works satisfactorily as long as the sheets are planar, but when the sheets are curved or warped, many of the apertures do not come into engagement with the sheet, with the result that the sheet is not firmly gripped by the movable plate.

An improvement on such a feed device incorporates one or more telescopic suction members which are adapted to be extended to the location of the sheet and then to draw the sheet down into engagement with a support plate, thereby aligning the sheet in the proper plane for feeding. Even though this is an improvement over the suction plate alone, nevertheless even the telescopic members are not effective when a sheet has a pronounced curvature, as the plane of the suction members, even though extended, forms an angle with the surface of the sheet so that the aperture of the suction member is not effectively blocked from the atmosphere. It is accordingly desirable to provide an alternative arrangement which is not subject to these disadvantages.

SUMMARY OF THE INVENTION

It is an object of the present invention to provide an arrangement for gripping and feeding a sheet which is effective to grip and feed the sheet even though it is severely curved or warped.

Another object of the present invention is to provide such a mechanism in a simple arrangement which can be easily and economically manufactured.

These and other objects and advantages of the present invention will become manifest upon an examination of the following description and the accompanying drawings.

In one embodiment of the present invention there is provided a telescopic suction member having a freely orientable suction head mounted on a cylinder, the cylinder being mounted to permit extension of such suction head for a limited distance when the suction head is open to the atmosphere.

BRIEF DESCRIPTION OF THE DRAWINGS

Reference will now be made to the accompanying drawings in which.

DESCRIPTION OF THE PREFERRED EMBODIMENTS

Figure 1:
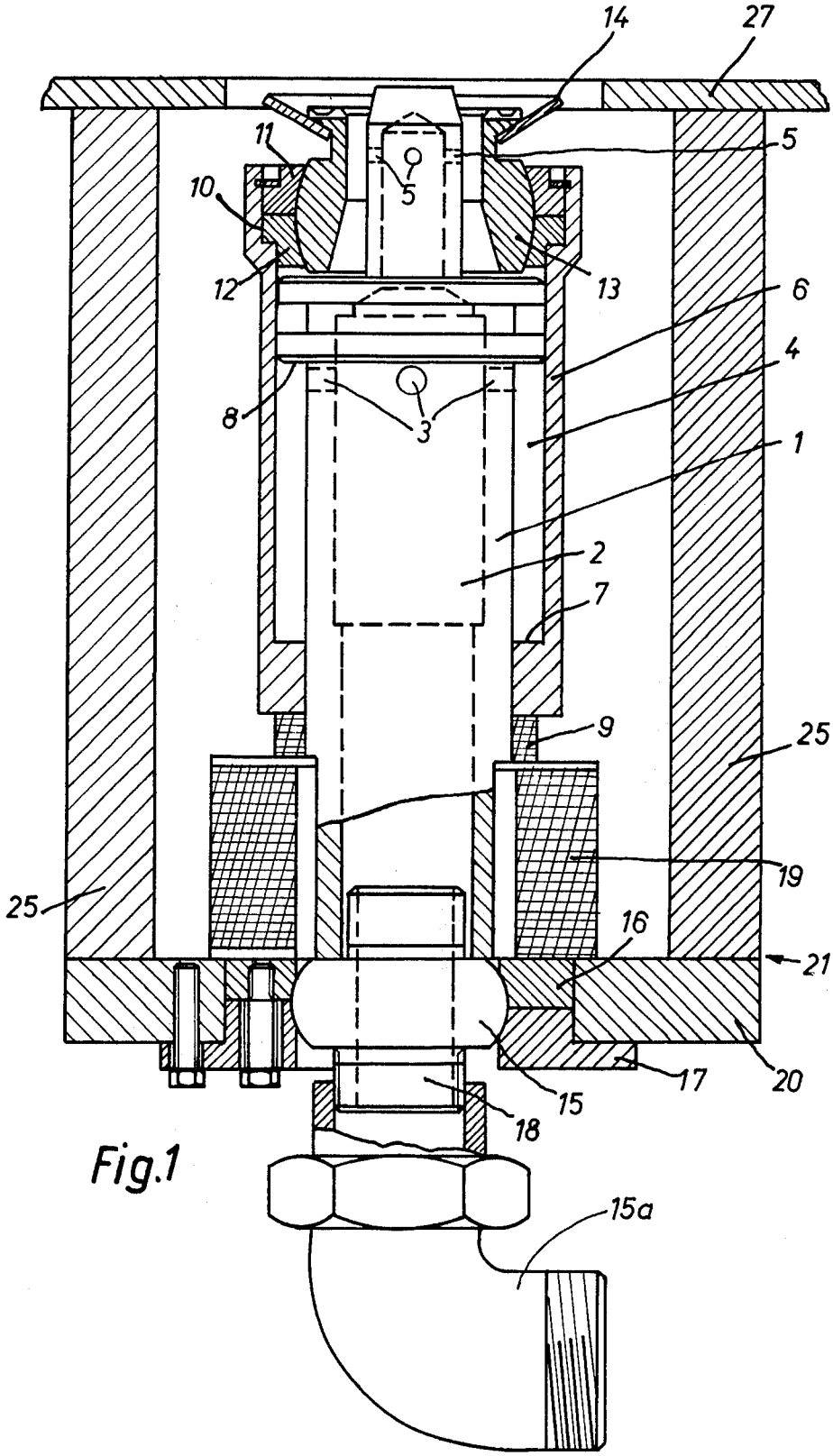
FIG. 1 is a longitudinal cross-sectional view of a suction member constructed in accordance with an illustrative embodiment of the present invention.

FIG. 1 of the drawings shows a longitudinal cross-section through a suction member constructed in accordance with the present invention. The suction member has a cylindrical body 1, which is provided with a central bore 2. Openings 3 connect the interior of the bore 2 with a chamber 4 which surrounds the portion of the body 1 and which is defined by a cylinder 6 which encircles a portion of the body 1 and is adapted to slide thereon in a longitudinal direction. At the extremity of the body 1, a plurality of openings 5, which are smaller in cross section than the openings 3, connect the interior of the central bore with the atmosphere.

A flange 8 is fixed to the body 1 and is adapted to fit snugly inside the cylinder 6 providing a bearing surface for the cylinder. The lower end of the cylinder 6 is provided with an inwardly directed flange 7 which is adapted to slide relative to the body 1. The flange 7, in cooperation with the flange 8, limits the outward extension of the cylinder 6 relative to the body 1. Movement of the cylinder 6 is limited in the opposite direction by engagement of the outer surface of the flange 7 with a flange 9 encircling the body 1 between the flange 9 and a resilient sleeve 19.

At the upper end of the cylinder 6, a housing 10 is provided in which are mounted two cages 11 and 12, each having an inner surface which is spherical in shape. A suction head comprises a ball 13 and a hollow resilient lip member 14, with a tubular portion interconnecting the hollow lip member 14 with a bore passing through the ball 13 to the upper portion of the cylinder 6. The ball 13 is maintained in position by the cages 11 and 12, and adapted for free pivoting relative to the center of the spherical surface. The lip member 14 is adapted to form an air-tight seal when it is in contact with a sheet, thereby cutting off the communication between the central bore 2 and the atmosphere via the apertures 5.

At the lower end of the body 1, a ball and socket joint has a ball member 15 disposed for free movement in a pair of cages 16 and 17, each having a spherical surface for trapping the ball member 15. The ball 15 is provided with a central aperture 18 which communicates with the central bore 2 of the body 1. The central bore 2 and the aperture 18 communicate with a pipe 15a which is connected to a pneumatic source of low pressure.

A resilient sleeve 19 is positioned surrounding the body 1 just beneath the flange 9, and is supported by an end wall 20, which also supports the cages 16 and 17. A tubular casing 25 is connected with the end wall 20, and supports another end wall 27 at its distal end, the wall 27 having an aperture for allowing the lip member 14 to rise above the level of the wall. The sleeve 19 maintains the body 1 in its normal position as illustrated in FIG. 1 in relation to the outer surface of the wall 27. The element 19 is adapted to yield to permit rotation of the ball member 15 in its socket in response to a tilting force applied to the body 1 or to the cylinder 6. When such a force is removed, the sleeve 19, due to its resilience or elasticity, causes the body 1 to resume the position illustrated in FIG. 1.

Figure 2:
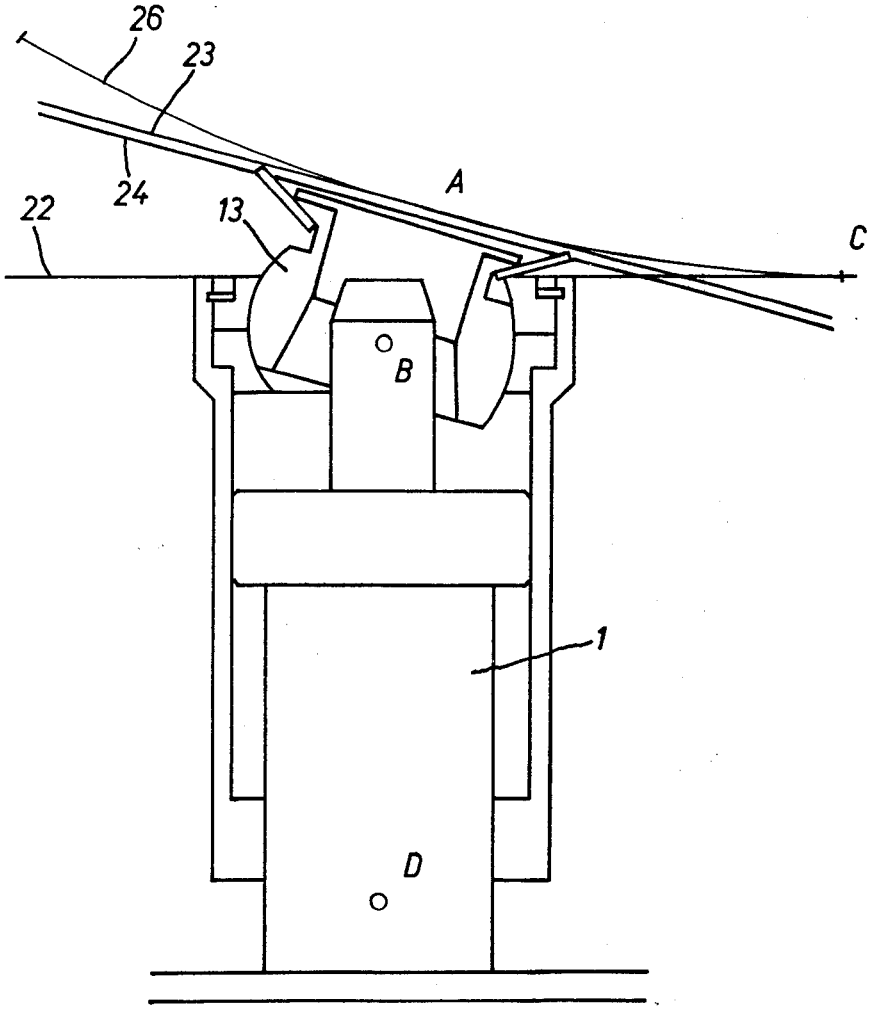
FIGS. 2 and 2*a* are plan views of the suction member of FIG. 1, illustrated in two different conditions of operation during the gripping of a convex sheet member.
Figure 2A:
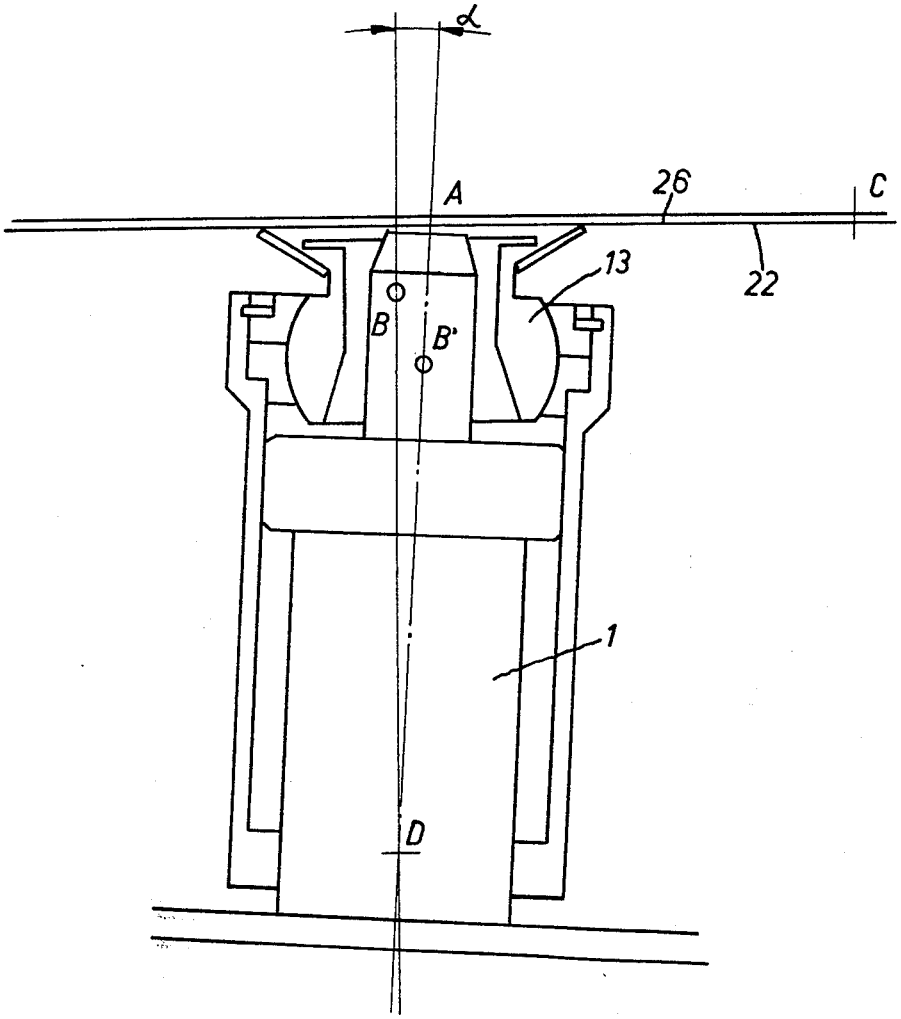
Figure 3:
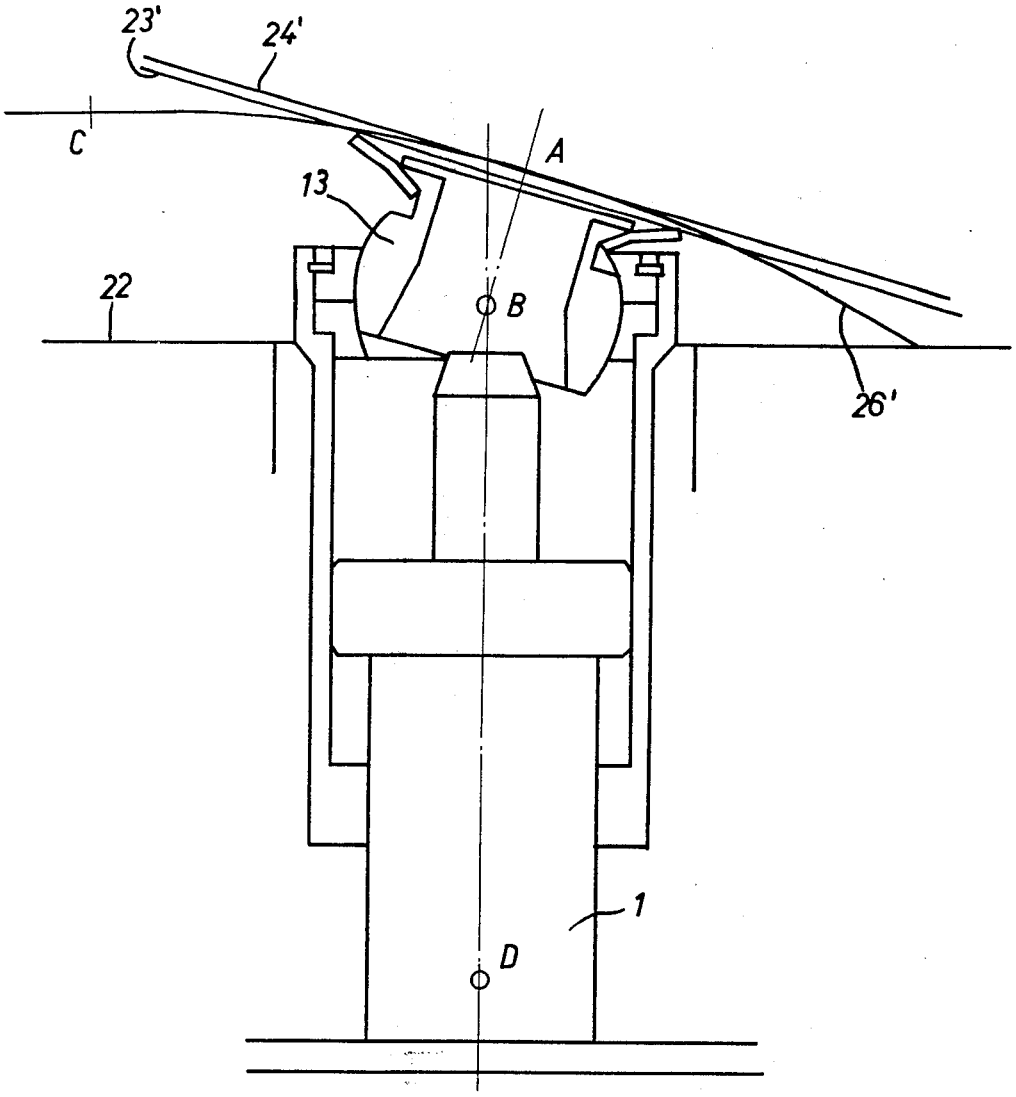
FIGS. 3 and 3*a* are side elevations of the apparatus illustrated in FIG. 1 during two conditions of operation during the gripping of a concave sheet.

FIGS. 2 and 3 illustrate the telescopic suction member during the process of gripping a sheet 26 which has a convex curvature, and drawing it into flat relationship with a surface 22, which may be the upper surface of a table, for example. The suction head member is raised relative to the surface of the table 22 until it comes into engagement with the sheet 26. Upon contact with the sheet, the suction head 13 tilts about an axis at point B so that the lip member 14 becomes oriented with the plane of the sheet 26 at point A, as illustrated in FIGS. 2 and 2*a*. The suction head is then drawn downwardly, pulling the sheet 26 with it until the sheet reaches a position of alignment with the surface 22 as illustrated in FIG. 2*a*.

As the suction head is lowered, the sheet bends about the point C, which is the beginning of the curvature of the sheet, and the body 1 of the suction member tilts slightly through an angle $\alpha$, rotating about an axis of revolution located at point D. The displacement of the body 1 through the angle $\alpha$ is caused by the fact that no sliding can occur between the sleeve 14 and the sheet 26.

Figure 3A:
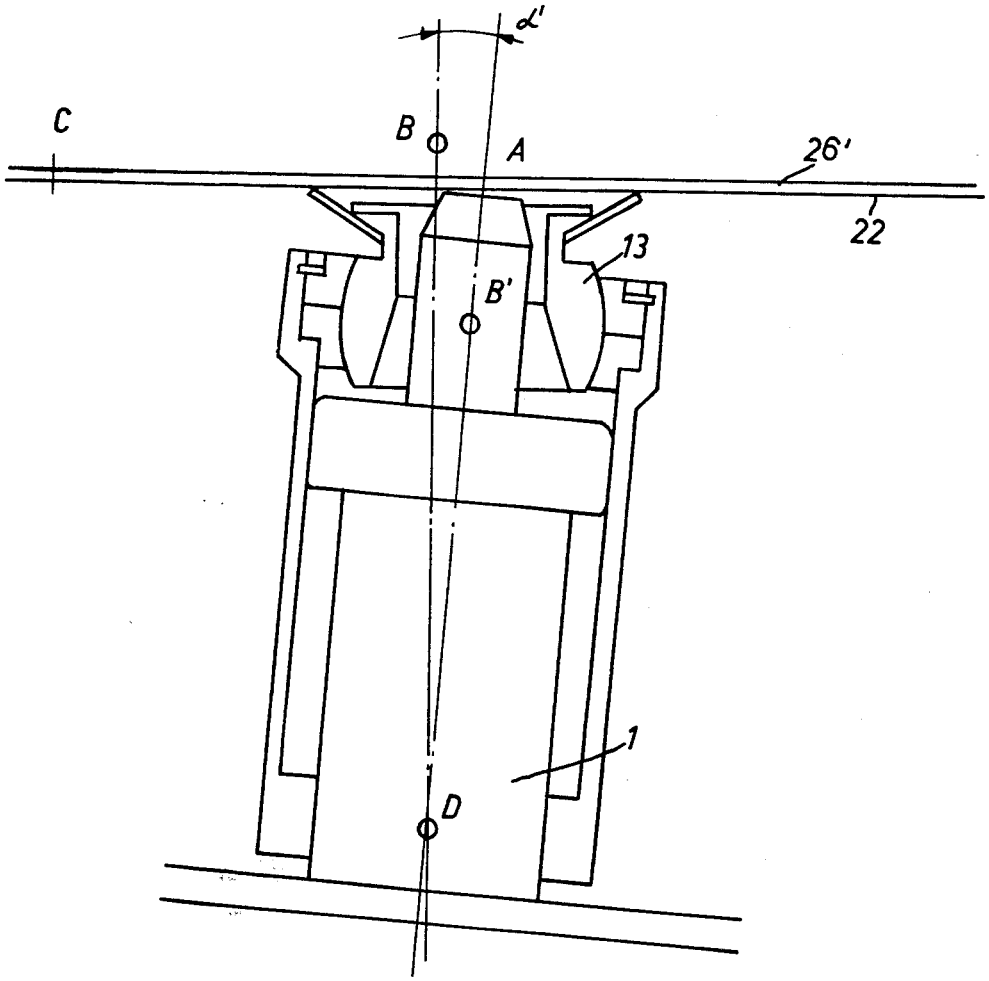

FIGS. 3 and 3*a* illustrate the operation of the suction head member when it is employed with a sheet having a concave bend. As shown in FIG. 3, the suction head has been raised to engage the sheet 26', and the head is tilted to become parallel to the plane of the sheet, tilting about an axis at the point B. As the sheet 26' is drawn downwardly into alignment with the surface 22, the body 1 shifts through an angle $\alpha'$ about its axis of rotation at point D, because no slippage is possible between the sleeve 14 and the sheet 26'. The suction head is lowered, bringing the same into alignment with the surface 22.

Figure 4:
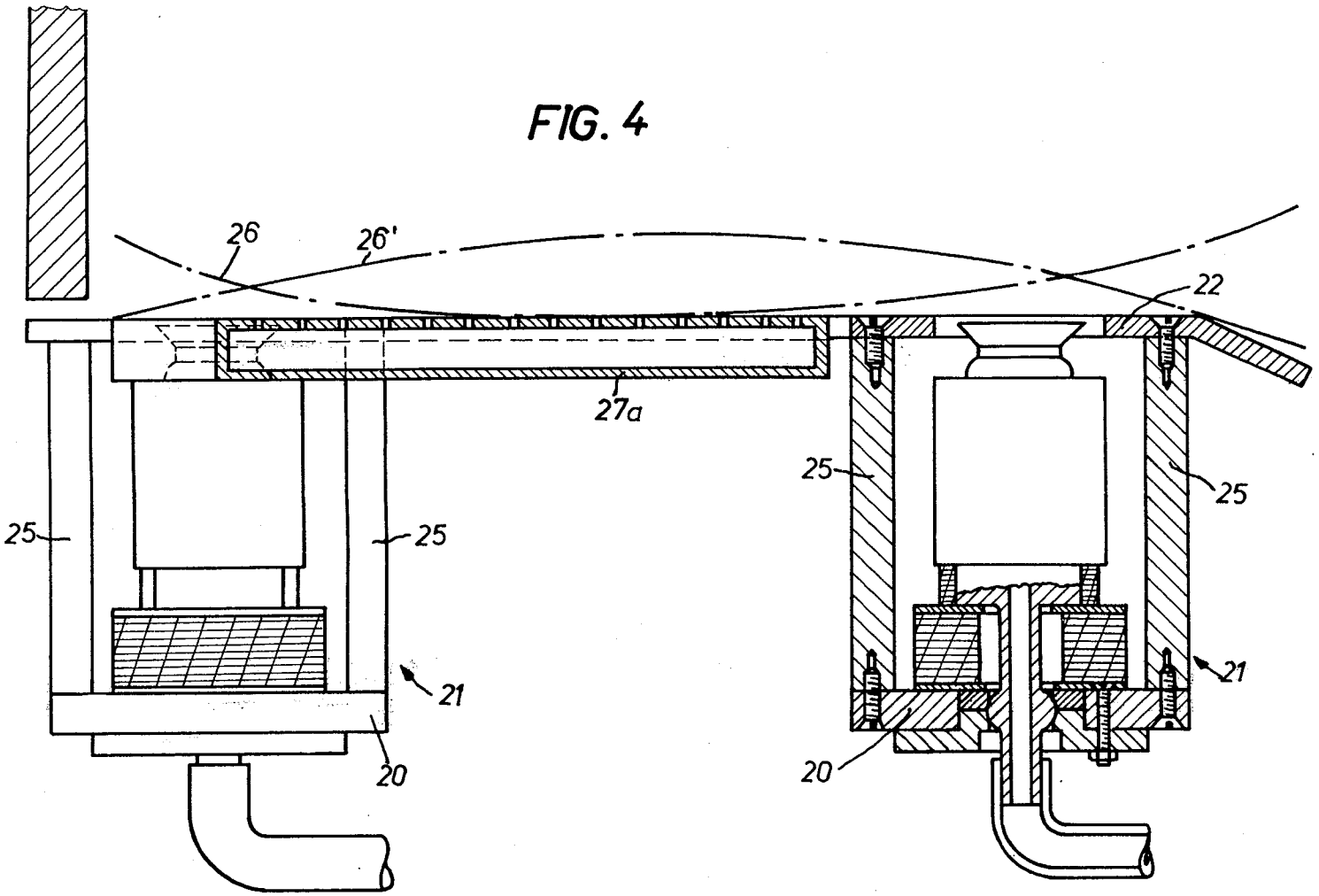
FIG. 4 is a vertical cross-section through a feed device incorporating a plurality of suction members constructed as illustrated in FIG. 1.

FIG. 4 shows a vertical section taken through a feed device having a movable suction plate 27 with the plane of its upper surface aligned with the plane of the surface 22. Several suction members of the type described in FIG. 1 are fixed to the member defining the surface 22 by means of a support bracket 21 comprising the end wall 20 and the casing 25, and are independent of the plate 27*a*. In an alternative embodiment, the extendable suction heads may be mounted in fixed relation to the plate 27*a* rather than in fixed relation to the table surface 22. The arrangement of FIG. 4 permits the sheets to be flattened against the upper surface of the movable suction plate 27 by the suction heads, which rise into juxtaposition with the lower surface of the sheet and, after gripping it, draw the sheet downwardly into co-incidence with the upper surface of the suction plate 27. All of the apertures in the upper surface of the plate 27 are then covered, and the plate 27 is accordingly effective to grip and to transport the sheet as desired.

Referring again to FIG. 1 the mechanism by which the cylinder 6 is raised and lowered will now be described. As the vacuum is applied to the central bore 2 of the body 1, at the time that the pipe 15*a* is connected with a vacuum source, the apertures 3 are adapted to evacuate air from the chamber 4, thus raising the cylinder 6 relative to the body 1. Although air is also drawn from the atmosphere through the apertures 5 into the central bore 2, the relatively smaller cross section of the apertures 5 render them less efficient than the apertures 3, and so the suction through the apertures 5 does not prevent the cylinder 6 from being raised.

At the moment when the sheet 26 is contacted, the sleeve 14 effects an air-tight seal, so that air can no longer be drawn through the apertures 5. Air is then evacuated from within the central bore 2, and because the cross-section of the interior of the cylinder 6 is larger above the flange 8 than below it, air is withdrawn from the chamber above the flange 8, and the cylinder 6 is accordingly drawn downwardly against the flange 9. When the cylinder 6 has been lowered so as to engage the flange 9, the sheet has been brought downward to the desired position.

It is apparent that through the operation of the present invention sheets may be readily grasped and drawn downwardly into flat relationship with a horizontal surface, thus permitting the plate 27 to advance the sheets as required. Even though the sheets may be severely warped, the tilting action of the suction heads accomodates for any warpage. No excess tension or force is placed on the sheets during this operation, because of the ability of the suction heads to tilt as the paper is lowered into the desired position.

Although the suction head apparatus of the present invention has been described, especially in connection with a sheet feeding machine, it is apparent that it may be employed in any apparatus in which it is desired to maintain a sheet in flat condition, relative to a specified surface, even though no feeding is desired.

What is claimed is:

1. A telescopic suction head assembly comprising a body, a cylinder slidable longitudinally on said body, a suction head, means for freely pivotally mounting said suction head on an end of said cylinder, whereby said suction head is free to freely tilt relative to said body and free to move rectilinearly relative to said body, and body mounting means for mounting said body in pivotally adjustable relation above a fixed support member, said body mounting means allowing said body to pivot equally freely in any direction relative to said support member.

2. Apparatus according to claim 1 wherein said body mounting means comprises a ball and socket joint, the socket of said joint being fixed to said support member, and the ball of said joint being fixed to an end of said body.

3. Apparatus according to claim 2, including resilient means connected between said body and said support member for causing said body to normally assume a predetermined attitude relative to said support member.

4. Apparatus according to claim 3, wherein said resilient means comprises a rubber sleeve surrounding said body and interposed between said body and said support member.

5. Apparatus according to claim 3, wherein said support member includes a generally horizontal surface disposed adjacent said suction head when said telescopic suction head assembly is in fully retracted position, said surface having an aperture therein aligned with said cylinder and said suction head to enable said suction head to pass upwardly through said aperture to a position spaced from said surface, said resilient means causing said body to normally assume an attitude in which said cylinder is slidable in a direction normal to said surface.

6. Apparatus according to claim 3, wherein said resilient means causes said body normally to assume a vertical attitude in which said suction head is located at the upper extremity of said cylinder.

7. Apparatus according to claim 6, wherein said support member includes a horizontal surface spaced slightly above said suction head when said cylinder is in its lowermost position.

8. Apparatus according to claim 7, wherein said surface has an aperture to pass said suction head, said resilient means being adapted to maintain said body in a generally vertical attitude as said cylinder and said suction head are raised through said aperture in said surface, said aperture being sized to permit said body to pivot relative to said support member as said cylinder is slid downwardly on said body to its lowermost position.

9. For use with a machine for handling sheet material, a method of orienting said sheets with a fixed table surface comprising the steps of providing a suction head member at a position below said table surface, supporting said suction head member on a body member, selectively raising said body member and selectively raising said suction head member above said table surface into engagement with said sheet, permitting said suction head to swivel relative to said body member for establishing an air-tight relationship with said sheet, and drawing said suction head member toward said table surface.

10. The method according to claim 9, including the step of tilting the member on which said suction head is supported for relieving stresses in said sheet as said sheet is drawn toward said table surface.

11. The method according to claim 9, including the step of mounting the member on which said suction head is supported in a predetermined spatial relationship to a table having a movable suction plate.

12. The method according to claim 11, including the step of mounting said suction head member in fixed relation to said movable suction plate.

13. Apparatus for flattening a sheet relative to a fixed plane supporting surface comprising a plurality of telescopic suction means juxtaposed with said surface in alignment with the peripheral edge thereof, each of said telescopic suction means comprising a suction head, a body for supporting said suction head for free pivotal movement relative to said body, a body member, mounting means for mounting said suction head relative to said body member, selectively operable means for extending each said suction head beyond said surface into engagement with a sheet spaced therefrom, to grip said sheet, whereby said sheet may be drawn into contact with said surface, a support member, pivot means mounting said body member pivotally relative to said support member, whereby each said suction head can move laterally relative to said surface for maintaining said sheet in a flat condition relative to said surface.

14. Apparatus according to claim 13, wherein said body member for each of said suction heads comprises a piston and cylinder arrangement interconnected between said suction head and said support member.

15. Apparatus according to claim 13, including a plane member defining said plane surface, said member having a plurality of apertures in alignment with the peripheral edge of said surface, said support means being secured to said plane member to support said suction heads centrally within their respective apertures, whereby they are free to move laterally within said apertures in any direction relative to said central position as a sheet is drawn into contact with said surface.

16. Apparatus according to claim 13, including a plane member for defining said plane surface, said plane member having suction means for flattening said sheet against said surface.

17. Apparatus according to claim 13, wherein said selectively operable means comprises means for extending said body relative to said body member until said suction head engages a sheet, and then automatically drawing said sheet to said suction head and retracting said body relative to said body member.

18. Apparatus according to claim 13, wherein said body member comprises a hollow member adapted to have its interior connected with a source of air at reduced pressure, said body comprises a cylinder slidable on said body member, and an aperture in said body communicating between said interior and a cavity defined between said body and body member, whereby said body is extended relative to said body member when said source is connected to said interior.

19. Apparatus according to claim 18, including a passageway communicating from said interior to said suction head, whereby said suction head is adapted to grip a sheet when said source is connected to said interior.

20. Apparatus according to claim 19, wherein said passageway is smaller in cross section than said aperture.

21. Apparatus according to claim 18, including a flange mounted on said body member and forming a bearing surface for said cylinder, said cavity defined by said flange, the exterior surface of said body member inwardly of said flange, and the interior surface of said cylinder inwardly of said flange.

22. Apparatus according to claim 21, including a passageway connecting the interior of said body member to the interior of said cylinder outwardly of said flange and to said suction head, said body having a reduced cross section outwardly of said flange, whereby said cylinder is retracted relative to said body when said suction head engages a sheet, by drawing air from the interior to said cylinder outwardly of said flange.

* * * * *